US010337288B2

(12) United States Patent
Gonzalez

(10) Patent No.: US 10,337,288 B2
(45) Date of Patent: Jul. 2, 2019

(54) SLIDING SLEEVE HAVING INDEXING MECHANISM AND EXPANDABLE SLEEVE

(71) Applicant: Weatherford Technology Holdings, LLC, Houston, TX (US)

(72) Inventor: Dick S. Gonzalez, Spring, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 450 days.

(21) Appl. No.: 15/174,489

(22) Filed: Jun. 6, 2016

(65) Prior Publication Data

US 2016/0362962 A1 Dec. 15, 2016

Related U.S. Application Data

(60) Provisional application No. 62/173,934, filed on Jun. 10, 2015.

(51) Int. Cl.
*E21B 23/00* (2006.01)
*E21B 34/06* (2006.01)
(Continued)

(52) U.S. Cl.
CPC ..... *E21B 34/14* (2013.01); *E21B 21/103* (2013.01); *E21B 23/006* (2013.01);
(Continued)

(58) Field of Classification Search
CPC ..... E21B 2034/007; E21B 21/103; E21B 23/006; E21B 33/122; E21B 34/063;
(Continued)

(56) References Cited

U.S. PATENT DOCUMENTS 5,146,992 A 9/1992 Baugh
5,244,044 A 9/1993 Henderson
(Continued)

FOREIGN PATENT DOCUMENTS

EP 2484862 A2 8/2012
EP 3018285 5/2016
(Continued)

OTHER PUBLICATIONS

Int'l Search Report and Written Opinion in counterpart PCT Appl. PCT/US2016/036228, dated Aug. 5, 2016, 6-pgs.
(Continued)

*Primary Examiner* — Daniel P Stephenson
(74) *Attorney, Agent, or Firm* — Blank Rome, LLP

(57) ABSTRACT

A downhole tool, such as a sliding sleeve, is operable with pressure applied against one of a plurality of plugs deployed in the tool. A sleeve can engage the deployed plugs and can move with the engagement. The sleeve extends in an absence of external support and releases the engaged plug. An indexing mechanism operable between the sleeve and an insert in the tool moves with the sleeve in response to the engagement with the deployed plugs and counts those engagements. In response to a predetermined count, the indexing mechanism forms the external support of the one deployed plug engaged in the sleeve and moves the insert with the pressure applied against the one deployed plug, which is engaged in the sleeve and supported by the indexing mechanism. For example, the insert can move open in the tool relative to a flow port communicating outside the tool.

21 Claims, 8 Drawing Sheets

(51) Int. Cl.

| | |
|---|---|
| ***E21B 34/14*** | (2006.01) |
| ***E21B 43/26*** | (2006.01) |
| ***E21B 21/10*** | (2006.01) |
| *E21B 34/00* | (2006.01) |
| *E21B 33/122* | (2006.01) |
| *E21B 43/14* | (2006.01) |
| *E21B 34/10* | (2006.01) |

(52) U.S. Cl.
CPC ..... *E21B 34/063* (2013.01); *E21B 43/26* (2013.01); *E21B 33/122* (2013.01); *E21B 34/103* (2013.01); *E21B 43/14* (2013.01); *E21B 2034/007* (2013.01)

(58) Field of Classification Search
CPC ..... E21B 34/103; E21B 34/14; E21B 43/14; E21B 43/26
See application file for complete search history.

(56) References Cited

U.S. PATENT DOCUMENTS

| | | | | |
|---|---|---|---|---|
| 6,966,368 | B2 | 11/2005 | Farquhar | |
| 7,322,417 | B2 | 1/2008 | Rytleweki et al. | |
| 7,681,650 | B2 | 3/2010 | Telfer et al. | |
| 8,261,761 | B2 * | 9/2012 | Gerrard | E21B 33/1208 137/1 |
| 8,272,445 | B2 * | 9/2012 | Fay | E21B 23/006 137/625.48 |
| 8,403,068 | B2 * | 3/2013 | Robison | E21B 23/006 166/194 |
| 8,701,776 | B2 * | 4/2014 | Smith | E21B 21/103 166/318 |
| 8,783,365 | B2 * | 7/2014 | McCoy | E21B 43/26 166/318 |
| 9,004,180 | B2 * | 4/2015 | Jackson | E21B 34/14 166/177.5 |
| 9,010,447 | B2 * | 4/2015 | Themig | E21B 34/14 166/386 |
| 9,234,406 | B2 * | 1/2016 | Naedler | E21B 43/14 |
| 9,303,475 | B2 * | 4/2016 | Hart | E21B 21/103 |
| 9,428,962 | B2 * | 8/2016 | Mahajan | E21B 7/28 |
| 10,018,015 | B2 * | 7/2018 | Purkis | E21B 23/04 |
| 2004/0154839 | A1 | 8/2004 | McGarian et al. | |
| 2008/0093080 | A1 | 4/2008 | Palmer et al. | |
| 2009/0308588 | A1 * | 12/2009 | Howell | E21B 21/103 166/66.4 |
| 2011/0073321 | A1 | 3/2011 | Fay et al. | |
| 2011/0203800 | A1 | 8/2011 | Tinker et al. | |
| 2011/0240301 | A1 | 10/2011 | Robison et al. | |
| 2011/0278017 | A1 | 11/2011 | Themig et al. | |
| 2013/0186644 | A1 * | 7/2013 | Smith | E21B 21/103 166/381 |
| 2014/0102703 | A1 * | 4/2014 | Mailand | E21B 23/006 166/279 |
| 2014/0138101 | A1 * | 5/2014 | Arabsky | E21B 34/14 166/387 |
| 2016/0130910 | A1 * | 5/2016 | Gonzalez | E21B 23/006 166/250.01 |
| 2016/0362962 | A1 * | 12/2016 | Gonzalez | E21B 34/14 |

FOREIGN PATENT DOCUMENTS

| | | | | |
|---|---|---|---|---|
| EP | 3018285 | A2 * | 5/2016 | E21B 23/006 |
| WO | 97/26089 | A1 | 10/1997 | |
| WO | 2010/127457 | A1 | 11/2010 | |
| WO | WO-2016200819 | A1 * | 12/2016 | E21B 34/14 |

OTHER PUBLICATIONS

First Office Action in counterpart CA Appl. 2984951, dated Oct. 5, 2018, 3-pgs.
Written Opinion in counterpart PCT Appl. PCT/US2016/036228, dated Aug. 5, 2016, 6-pgs.
First Office Action in counterpart Canadian Appl. 2984951, dated Oct. 5, 2018, 3-pgs.

* cited by examiner

SLIDING SLEEVE HAVING INDEXING MECHANISM AND EXPANDABLE SLEEVE

CROSS-REFERENCE TO RELATED APPLICATIONS

This application claims the benefit of U.S. Prov. Appl. 62/173,934, filed 10 Jun. 2015, which is incorporated herein by reference.

BACKGROUND OF THE DISCLOSURE

In a staged fracturing operation, multiple zones of a formation need to be isolated sequentially for treatment. To achieve this, operators install a fracturing assembly down the wellbore, which typically has a top liner packer, open hole packers isolating the wellbore into zones, various sliding sleeves, and a wellbore isolation valve. When the zones do not need to be closed after opening, operators may use single shot sliding sleeves for the fracturing treatment. These types of sleeves are usually ball-actuated and lock open once actuated. Another type of sleeve is also ball-actuated, but can be shifted closed after opening.

Initially, operators run the fracturing assembly in the wellbore with all of the sliding sleeves closed and with the wellbore isolation valve open. Operators then deploy a setting ball to close the wellbore isolation valve. This seals off the tubing string of the assembly so the packers can be hydraulically set. At this point, operators rig up fracturing surface equipment and pump fluid down the wellbore to open a pressure-actuated sleeve so a first zone can be treated.

As the operation continues, operates drop successively larger balls down the tubing string and pump fluid to treat the separate zones in stages. When a dropped ball meets its matching seat in a sliding sleeve, the pumped fluid forced against the seated ball shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

FIG. 1A shows an example of a sliding sleeve 10 for a multi-zone fracturing system in partial cross-section in an opened state. This sliding sleeve 10 is similar to Weatherford's ZoneSelect MultiShift fracturing sliding sleeve and can be placed between isolation packers in a multi-zone completion. The sliding sleeve 10 includes a housing 20 defining a bore 25 and having upper and lower subs 22 and 24. An inner sleeve or insert 30 can be moved within the housing's bore 25 to open or close fluid flow through the housing's flow ports 26 based on the inner sleeve 30's position.

When initially run downhole, the inner sleeve 30 positions in the housing 20 in a closed state. A breakable retainer 38 initially holds the inner sleeve 30 toward the upper sub 22, and a locking ring or dog 36 on the sleeve 30 fits into an annular slot within the housing 20. Outer seals on the inner sleeve 30 engage the housing 20's inner wall above and below the flow ports 26 to seal them off.

The inner sleeve 30 defines a bore 35 having a seat 40 fixed therein. When an appropriately sized ball B lands on the seat 40, the sliding sleeve 10 can be opened when tubing pressure is applied against the seated ball B to move the inner sleeve 30 open. To open the sliding sleeve 10 in a fracturing operation once the appropriate amount of proppant has been pumped into a lower formation's zone, for example, operators drop an appropriately sized ball B downhole and pump the ball B until it reaches the landing seat 40 disposed in the inner sleeve 30.

Once the ball B is seated, built-up pressure forces against the inner sleeve 30 in the housing 20, shearing the breakable retainer 38 and freeing the lock ring or dog 36 from the housing's annular slot so the inner sleeve 30 can slide downward. As it slides, the inner sleeve 30 uncovers the flow ports 26 so flow can be diverted to the surrounding formation. The shear values required to open the sliding sleeves 10 can range generally from 1,000 to 4,000 psi (6.9 to 27.6 MPa).

Once the sleeve 10 is open, operators can then pump proppant at high pressure down the tubing string to the open sleeve 10. The proppant and high pressure fluid flows out of the open flow ports 26 as the seated ball B prevents fluid and proppant from communicating further down the tubing string. The pressures used in the fracturing operation can reach as high as 15,000-psi.

After the fracturing job, the well is typically flowed clean, and the ball B is floated to the surface. Then, the ball seat 40 (and the ball B if remaining) is milled out. The ball seat 40 can be constructed from cast iron to facilitate milling, and the ball B can be composed of aluminum or a non-metallic material, such as a composite. Once milling is complete, the inner sleeve 30 can be closed or opened with a standard "B" shifting tool on the tool profiles 32 and 34 in the inner sleeve 30 so the sliding sleeve 10 can then function like any conventional sliding sleeve shifting with a "B" tool. The ability to selectively open and close the sliding sleeve 10 enables operators to isolate the particular section of the assembly.

Because the zones of a formation are treated in stages with the sliding sleeves 10, the lowermost sliding sleeve 10 has a ball seat 40 for the smallest ball size, and successively higher sleeves 10 have larger seats 40 for larger balls B. In this way, a specific sized ball B dropped in the tubing string will pass though the seats 40 of upper sleeves 10 and only locate and seal at a desired seat 40 in the tubing string. Despite the effectiveness of such an assembly, practical limitations restrict the number of balls B that can be effectively run in a single tubing string.

Depending on the pressures applied and the composition of the ball B used, a number of detrimental effects may result. For example, the high pressure applied to a composite ball B disposed in a sleeve's seat 40 that is close to the ball's outer diameter can cause the ball B to shear right through the seat 40 as the edge of the seat 40 cuts off the sides of the ball B. Accordingly, proper landing and engagement of the ball B and the seat 40 restrict what difference in diameter the composite balls B and cast iron seats 40 must have. This practical limitation restricts how many balls B can be used for seats 40 in an assembly of sliding sleeves 10.

In general, a fracturing assembly using composite balls B may be limited to thirteen to twenty-one sliding sleeves depending on the tubing size involved. For example, a tubing size of 5½-in. can accommodate twenty-one sliding sleeves 10 for twenty-one different sized composite balls B. Differences in the maximum inner diameter for the ball seats 40 relative to the required outside diameter of the composite balls B can range from 0.09-in. for the smaller seat and ball arrangements to 0.22-in. for the larger seat and ball arrangements. In general, the twenty-one composite balls B can range in size from about 0.9-in. to about 4-in. with increments of about 0.12-in between the first eight balls, about 0.15-in. between the next eight balls, about 0.20-in between the next three balls, and about 0.25-in. between the last two balls. The minimum inner diameters for the twenty-one seats 40 can range in size from about 0.81-in. to about 3.78-in, and the increments between them can be comparably configured as the balls B.

When aluminum balls B are used, more sliding sleeves 10 can be used due to the close tolerances that can be used between the diameters of the aluminum balls B and iron seats 40. For example, forty different increments can be used for sliding sleeves 10 having solid seats 40 used to engage aluminum balls B. However, an aluminum ball B engaged in a seat 40 can be significantly deformed when high pressure is applied against it. Any variations in pressuring up and down that allow the aluminum ball B to seat and to then float the ball B may alter the shape of the ball B compromising its seating ability. Additionally, aluminum balls B can be particularly difficult to mill out of the sliding sleeve 10 due to their tendency of rotating during the milling operation. For this reason, composite balls B are preferred.

Due to the limitations associated with conventional sliding sleeves, stimulation sleeves, such as the I-ball from Weatherford, have been developed that use an indexing mechanism allowing the use of one ball size to operate multiple sleeve. Details of this type of stimulation sleeve are disclosed in US 2013/0186644 and U.S. Pat. No. 8,701,776, which are incorporated herein by reference.

Although the many types of sleeves used in the art are effective, operators continually seek solutions that do not allow for flow to bypass around a seated ball because operators continually seek to limit treatment fluid from flowing past the seated ball into the zones below. To that end, the subject matter of the present disclosure is directed to overcoming, or at least reducing the effects of, one or more of the problems set forth above.

SUMMARY OF THE DISCLOSURE

A downhole tool is disposed on tubing and is operable with pressure applied against one of a plurality of plugs deployed in the tool. The tool comprises an insert, an insert, a sleeve, and an indexing mechanism. The insert is disposed in the tool and is movable from a first position toward a second position. The sleeve is disposed in the tool, is engageable with the deployed plugs, and is movable with the engagement. The sleeve is expansive in an absence of external support and releases the engaged plug in response to the expansion.

The indexing mechanism is disposed in the tool and is operable between the sleeve and the insert. In response to the engagement with the deployed plugs, the indexing mechanism moves with the sleeve and counts the engagements. In response to a predetermined count of the engagements, the indexing mechanism forms the external support of the one deployed plug and moves the insert from the first position toward the second position with the pressure applied against the one deployed plug, which is engaged in the sleeve and is supported by the indexing mechanism.

For example, the downhole tool can be a sliding sleeve tool disposed on a tubing downhole. The sliding sleeve tool can open with one of a plurality of plugs deployed down the tubing. In this case, the tool can have a housing that defines a first bore and that defines a flow port communicating the first bore outside the housing. The insert is disposed in the first bore of the housing and defines a second bore therethrough for passage of the plugs. The sleeve is also disposed in the first bore of the housing and defines a third bore therethrough for passage of the plugs. The insert is movable inside the first bore from a closed position to an opened position relative to the flow port.

In the tool, the indexing mechanism operable between the sleeve and the insert is reciprocally movable in first and second opposite directions up to the predetermined count. The indexing mechanism is biased relative to a portion of the housing. In this way, the indexing mechanism counts the movement of the sleeve in the first direction by the engagement of one or more initial of the deployed plugs and resets in the second direction with the bias relative to the portion. The indexing mechanism at the predetermined count provides the external support for the engagement of a last of the deployed plugs. The portion of the tool can be a seat against which the indexing mechanism is biased, and this seat can be fixed in the tool or can be movable in the tool in the first direction.

In one embodiment, the indexing mechanism comprises a collet operable between the sleeve and the insert. The collet has fingers biasing against a surface in the first bore of the housing. The collet is affixed to the sleeve. Thus, the sleeve moving in a first direction in the housing with the engagement of the deployed plug moves the collet in the first direction toward the surface. Likewise, the collet moving in a second direction opposite to the first direction by the bias of the fingers against the surface moves the sleeve in the second direction in the housing. The surface of the tool can be an inclined surface of a seat against which the collet fingers are biased. This seat can be fixed in the tool or can be movable (shiftable) in the tool in the first direction.

A pin and slot arrangement couples the collet to the insert and allows movement of the collet relative to the insert from a start position, to at least one intermediate position, and to a final position. In response to the engagement of a first of the deployed plugs with the sleeve, the pin and slot arrangement allows the collet to move in the first direction relative to the insert from the start position to a first stop position. The fingers of the collet in the first stop position leave the sleeve in the absence of the external support.

In response to the release of the first deployed plug and with the bias of the fingers of the collet, the pin and slot arrangement allows the collet to move in the second direction relative to the insert from the first stop position to the at least one intermediate position. In response to the engagement of a second of the deployed plugs with the sleeve, the pin and slot arrangement allows the collet to move in the first direction relative to the insert from the at least one intermediate position to the final position; and wherein the fingers of the collet in the final position provide external support to the sleeve to hold the second deployed plug engaged therein.

In the tool, the sleeve comprises a restriction therein for engaging with the deployed plugs, and the restriction at least partially is longitudinally rigid and radially flexible. The sleeve comprises a tubular structure with a continuous wall thereabout, the restriction being a throat of reduced diameter formed around the continuous wall.

According to the present disclosure, an apparatus is operable with a plurality of plugs deployed through tubing downhole in a borehole. The apparatus comprises first and second tools disposed on the tubing and configured to operate in response respectively to a first count and a second count of the deployed plugs. Each of the first and second tools comprises an insert, a sleeve, and an indexing mechanism as disclosed above. As such, the indexing mechanism operable between the sleeve and the insert of the tool forms the external support in response to the respective count.

According to the present disclosure, a method for tubing downhole in a borehole involves deploying one or more initial plugs downhole to a first tool on the tubing. The first tool indexes to a first count by reciprocally moving (shifting) a radially expandable sleeve in first and second opposite directions in the first tool with the one or more first plugs engaged therein and releasing the one or more initial plugs from the radially expandable sleeve. The method further involves deploying a subsequent plug downhole to the first tool indexed to the first count; and moving (shifting) the radially expandable sleeve in the first direction in the first tool with the subsequent plug engaged therein. The subsequent plug is held in the first tool by radially supporting the radially expandable sleeve, and an insert is actuated in the first tool in response to fluid pressure applied against the subsequent plug, which is held in the radially supported sleeve.

Indexing the first tool to the first count can involve guiding a pin in a slot defined between the insert and the radially expandable sleeve. Reciprocally moving the sleeve can involve biasing the sleeve in the second direction opposite to the movement the sleeve in the first direction by the engagements with the deployed plugs. Radially supporting the radially expandable sleeve can involve wedging collet fingers around the radially expandable sleeve with the shifting of the sleeve. Actuating the insert in the first tool can involve shifting the insert relative to a flow port communicating outside the first tool.

The method can further involve indexing a second tool uphole of the first tool to a second count so an insert can be actuated in the second tool in response to fluid pressure applied against a following plug held in the radially supported sleeve.

The foregoing summary is not intended to summarize each potential embodiment or every aspect of the present disclosure.

DETAILED DESCRIPTION OF THE DISCLOSURE

Figure 1A:
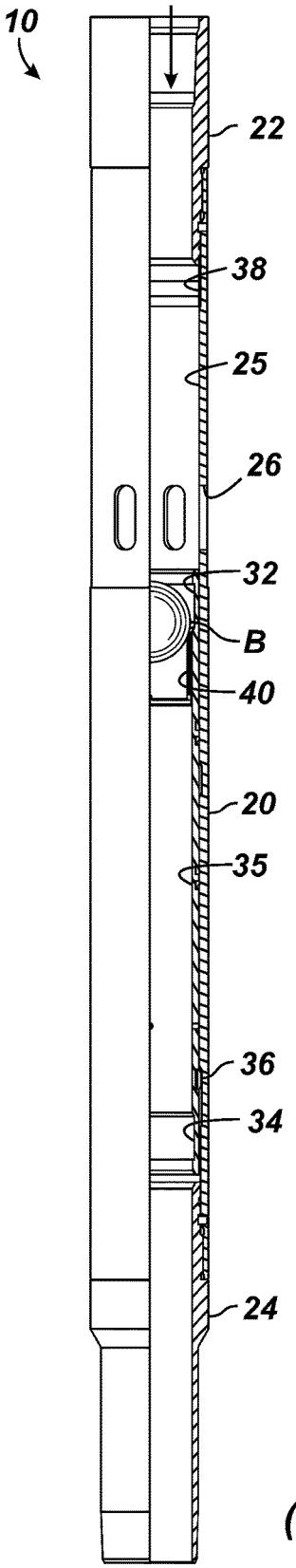
FIG. 1A (Prior Art)
FIG. 1A illustrates a sliding sleeve according to the prior art having a ball engaged with a seat to open the sliding sleeve.
Figure 1B:
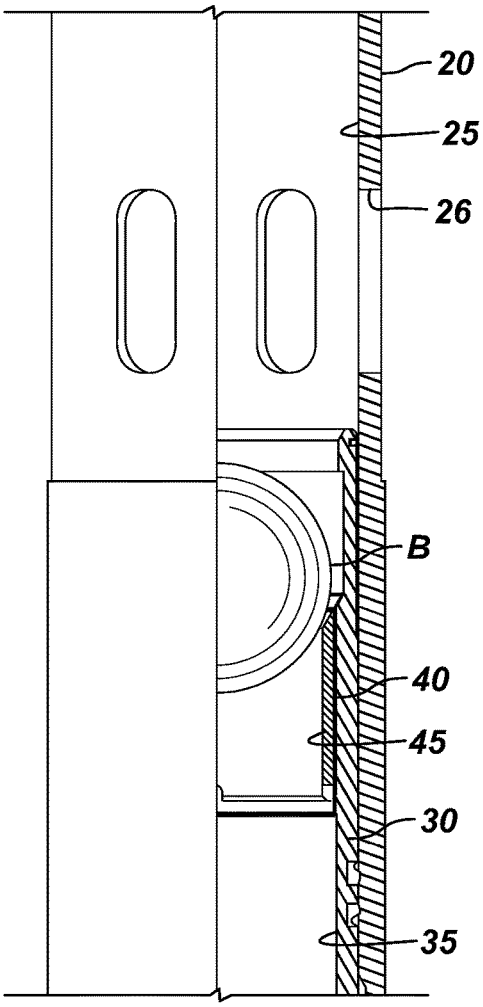
FIG. 1B (Prior Art)
FIG. 1B illustrates a close up view of the sliding sleeve in FIG. 1A.
Figure 2:
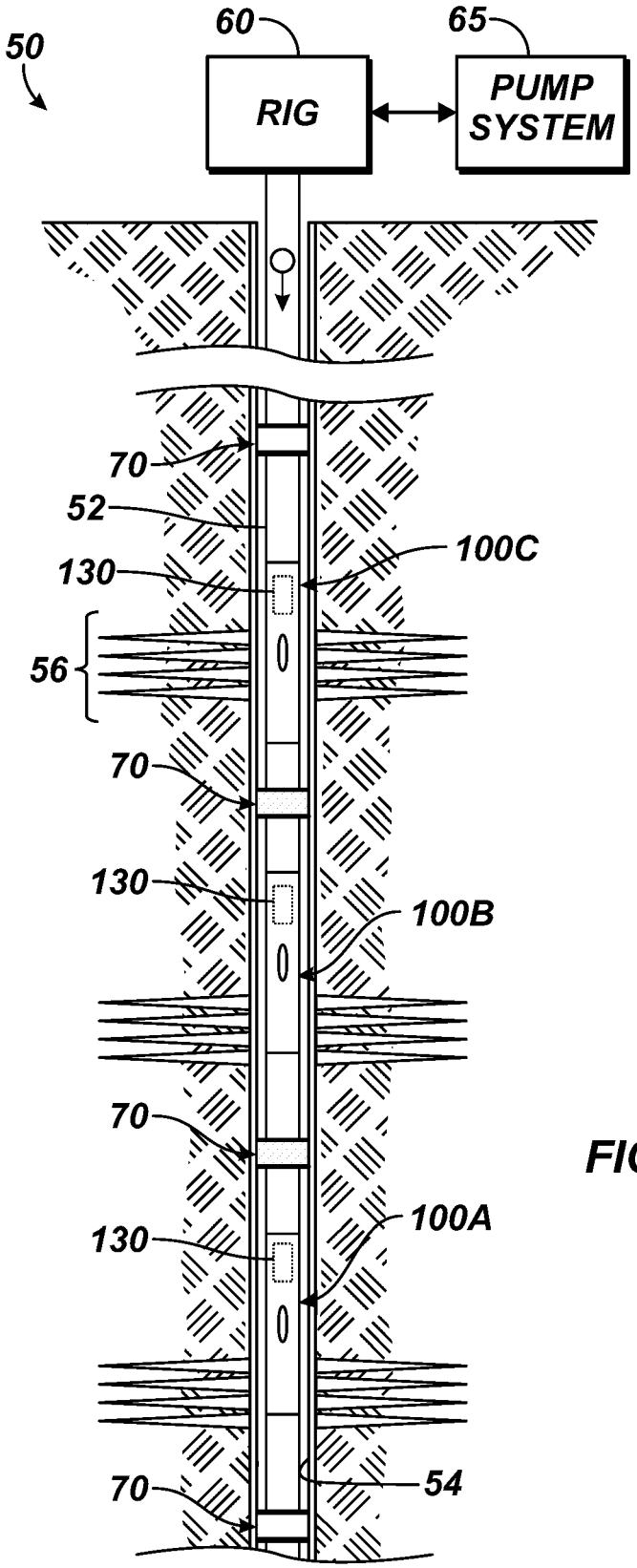
FIG. 2 illustrates a treatment assembly having a plurality of sliding sleeve tools according to the present disclosure.

FIG. 2 shows a treatment assembly 50 having an arrangement of sliding sleeve tools (100A-C) according to the present disclosure. As shown, a tubing string 52 deploys in a wellbore 54. The string 52 has the several sliding sleeve tools 100A-C disposed along its length, and various packers 70 may isolate portions of the wellbore 54 into isolated zones. In general, the wellbore 54 can be an opened or cased hole, and the packers 70 can be any suitable type of packer intended to isolate portions of the wellbore 54 into isolated zones.

The tools 100A-C can be used to divert treatment fluid, such as fracture fluid, selectively to the isolated zones of the surrounding formation. The tubing string 52 can be part of a fracturing assembly, for example, having a top liner packer (not shown), a wellbore isolation valve (not shown), and other packers and sleeves (not shown) in addition to those shown. If the wellbore 54 has casing, then the wellbore 54 can have casing perforations 56 at various points.

As conventionally done, operators deploy a setting ball (not shown) to close a wellbore isolation valve (not shown) positioned lower downhole on the tubing string 52. Indexing mechanisms 130 in each of the tools 100A-C allow the setting ball to pass therethrough. Then, operators rig up fracturing surface equipment 65 and pump fluid down the wellbore 54 to open a pressure actuated sleeve (not shown) toward the end of the tubing string 52. This treats a first zone of the wellbore 54.

In later stages of the operation, operators successively actuate the tools 100A-C to treat the isolated zones. In particular, operators deploy plugs B (e.g., balls or the like) down the tubing string 52. Each plug B can be the same size and can be configured to seat in any one of the tools 100A-C once the sleeve's indexing mechanism 130 has been activated to a final state after counting successively passed plugs B. In general, the tools 100A-C are activated uphole along the tubing string 52 in successive stages so that the successive intervals up the wellbore 54 can be treated. When not in the final state, the indexing mechanisms 130 of the tools 100A-C can pass those plugs B intended for lower tools 100A-C.

As will be described in more detail below, features of the indexing mechanism 130 use a seating sleeve and a collet to engage and count deployed plugs B. As configured, these components either reset to an intermediate state to engage one or more successive plugs B, or these components activate to a final state in response to a predetermined count of the deployed plugs B in the given tool 100A-C. Once the components are activated to the final state, the tools 100A-C engages the deployed plug B and can be opened with applied fluid pressure.

With a general understanding of the disclosed tool 100 and the assembly 50 in which it can be used, discussion now turns to an embodiment of a sliding sleeve tool according to the present disclosure.

Figure 3A:
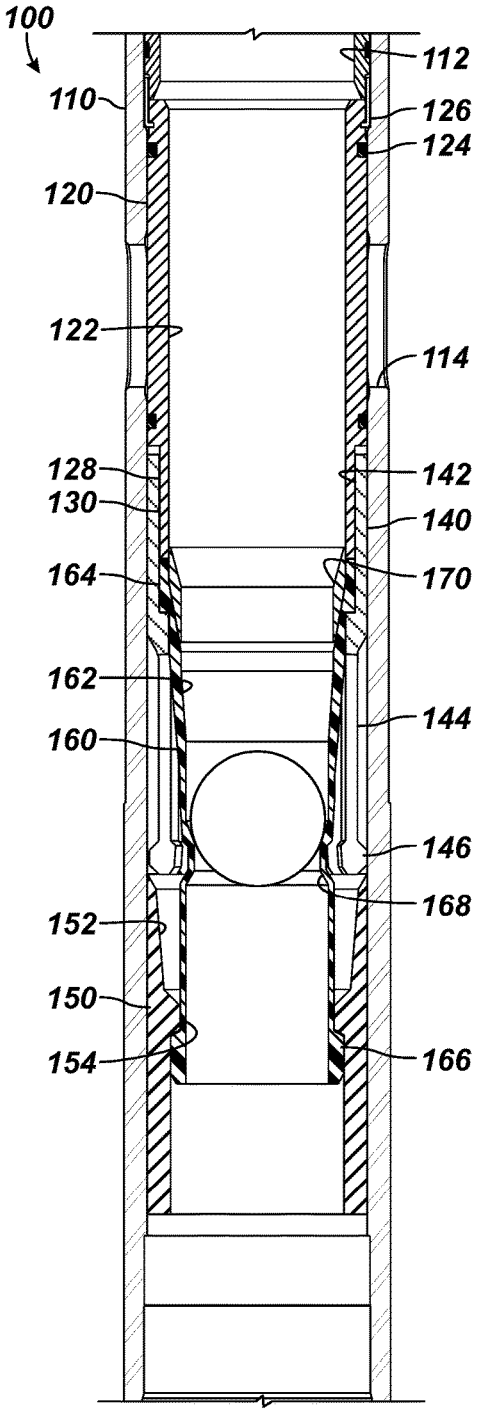
FIG. 3A illustrates a sliding sleeve tool according to the present disclosure in an initial condition.

FIG. 3A illustrates an embodiment of a sliding sleeve tool 100 according to the present disclosure in an initial condition. The tool 100 can be part of a multi-zone fracturing system, such as discussed previously, that uses the tool 100 to open and close communication with a borehole annulus. In such an assembly, the tool 100 can be placed on tubing string between isolation packers in the multi-zone completion.

The tool 100 includes a housing 110 with an inner bore 112 and one or more ports 114. Upper and lower ends of the housing 110 can coupled to tubing components of a tubing string in a conventional manner and are not shown here. An inner sleeve or insert 120 can move axially within the housing's bore 122 to open or close fluid flow through the housing's ports 114 based on the insert 120's position.

During operations, for example, the insert 120 is typically moved axially in a downward direction inside the bore 122 from a closed position to an opened position relative to the flow ports 114.

The indexing mechanism 130 is coupled between a seating sleeve 160 and the insert 120. In particular, the indexing mechanism 130 includes a collet 140 that can move axially with the seating sleeve 160 in response to the engagement with the deployed plugs B. During operations, the collet 140 then acts as a spring to return the indexing mechanism 130 to an intermediate state and eventually acts a support for the seating sleeve 160 in a final state. In this way, the indexing mechanism 130 allows for several same size (or various size) plugs B to pass through the tool 100 until a predetermined count has been reached.

When initially run downhole, the insert 120 positions in the housing 110 in a closed state, as in FIG. 3A. A retaining element 126, such as a conventional shear ring, can engage the insert 120 to temporarily hold the insert 120 toward the closed condition so outer seals 124 on the insert 120 engage the housing's bore 112 both above and below the flow ports 114 to seal them off.

The tool 100 is designed to open when a preconfigured number of one or more plugs (e.g., balls B) lands in the seating sleeve 160 and tubing pressure is applied to actuate the indexing mechanism 130 to count the preconfigured number of times. (Although a ball B is shown and described, any conventional type of plug, dart, ball, cone, or the like may be used. Therefore, the term "ball" as used herein is merely meant to be illustrative.)

The seating sleeve 160 is attached at one end 164 to the collet member 140. As shown, an internal retainer 170 in the form of an inclined ring can be used to affix this sleeve's end 164 to the collet member 140. A second end 166 of the seating sleeve 160 extends beyond the fingers 144 and the heads 146 of the collet member 140 and engages inside a seat member 150 held inside the housing's bore 112.

As shown, the seating sleeve 160 is generally cylindrical in nature and defines an internal passage 162 communicating the insert's passage 122 with the lower end of the seat member 150 and the housing's bore 112. The sleeve's internal passage 162, however, includes a restricted diameter or seating area 168 therein for engaging balls deployed through the passage 162 during operations as described below.

Figure 4:
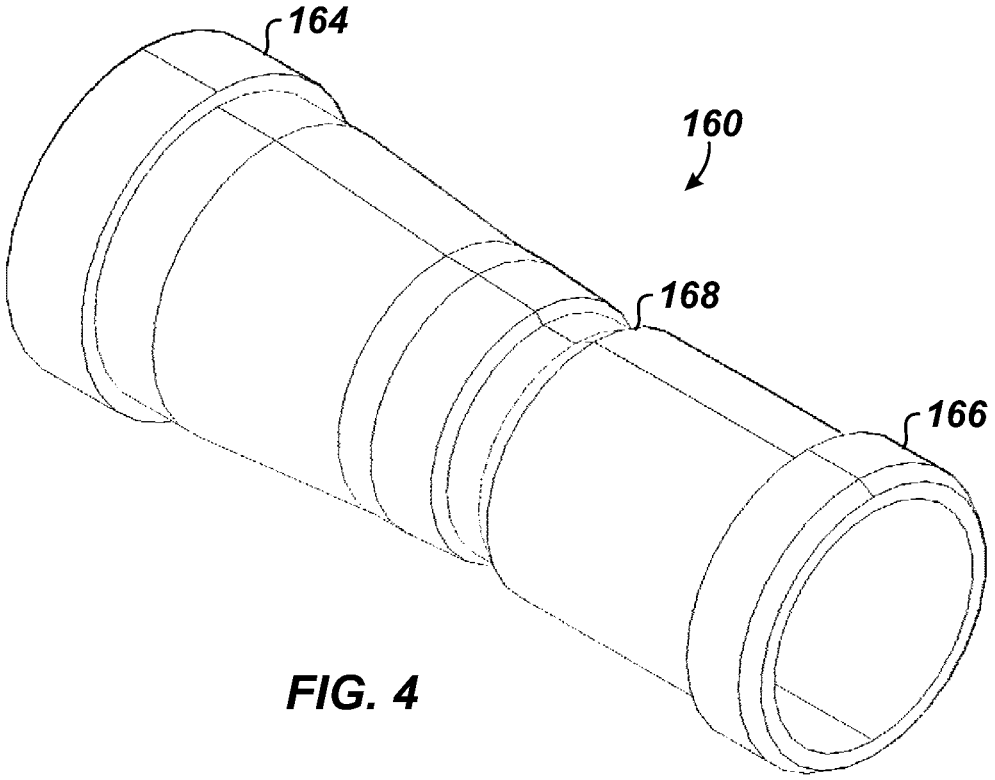
FIG. 4 illustrates a perspective view of the seating sleeve for the disclosed tool.

For further reference, FIG. 4 illustrates a perspective view of the outside surface of the disclosed seating sleeve 160. As shown from the exterior, the sleeve 160 come inward to the restriction 168 of the inner passage (162) for engaging with the deployed plugs. The restriction 168 at least partially is axially rigid and radially flexible. Preferably, the sleeve 160 is a tubular structure with a continuous wall thereabout so that the restriction 168 is a throat of reduced diameter formed around the continuous wall.

During operations as described in more detail below, the seating sleeve 160 as shown in FIG. 3A makes contact with a deployed plug B as the deployed plug B enters the sleeve's bore 162 and engages the seating area 168. When the plug B is engaged, the seating sleeve 160 is movable axially downward with the engagement of the plug B, and the translation actuates the spring collet member 140 and starts the count of the indexing mechanism 130.

The seating sleeve 160 can be composed of rubber or other semi-rigid but flexible material. For example, the seating sleeve 160 can be composed of any suitable material, such as an elastomer, a thermoplastic, an organic polymer thermoplastic, a polyetheretherketone (PEEK), a thermoplastic amorphous polymer, a polyamide-imide, TORLON®, a soft metal, etc., and a combination thereof. (TORLON is a registered trademark of SOLVAY ADVANCED POLYMERS L.L.C.)

The seating sleeve 160 preferably has solid walls to prevent any erosion when sand flows through the inside of the tool 100 during treatment. The seating sleeve 160 serves as a dampening mechanism for the plugs B so that the plugs B do not impact metal edges. The seating sleeve 160 also serves as extra sealing support for the plug B in its final sequence discussed later.

Engaging the seating sleeve 160, the plug B creates a restriction that moves the seating sleeve 160 downward and collapses the support member of the collet's fingers 144. As long as the seating sleeve 160 remains externally unsupported, the seating sleeve 160 can expand radially, especially at the seating area 168, in an absence of the external support. At this point, the seating sleeve 160 can thereby release the engaged plug B from the bore 162.

To engage and release, the seating sleeve 160 is radially expandable at least when a predetermined pressure is applied against the engaged ball B. The seating sleeve 160 then expands to let the plug B through, and the collet's fingers 144 are in turn used as a spring to retract the indexing mechanism 130 to its next position.

At this point, the collet 140 and the seating sleeve 160 then retract back to an intermediate state to accept the next deployed plug B. This counting is repeated until a final plug B engages in the seating sleeve 160 and is prevented from passing through the seating sleeve 160 by the supported engagement of the collet 140. With the final plug B "caught" in the tool 100, the insert 120 can be opened to pass treatment fluid from the tubing string into the wellbore.

As can be seen in the above description, the indexing mechanism 130 counts the engagement of the deployed plugs B, and the collet 140 forms external support of the seating sleeve 160 in response to a predetermined count. Once this count is reached, the collet 140 is coupled by the indexing mechanism 130 to move the insert 110 axially in the housing's bore 112 from the closed condition to the open condition with applied pressure against the engaged plug B in the seating sleeve 160 supported by the collet member 140.

Turning now to the particulars of the tool 100 as shown in FIG. 3A, an inner surface 142 on the upper end of the collet member 140 fits partially on an external surface 128 on the lower end of the insert 120. The two surfaces 142, 128 can move relative to one another, and the collet member 140 and insert 120 can move independently of one another or together depending on the current configuration of the indexing mechanism 130 defined between these two members 120, 140.

Figure 6:
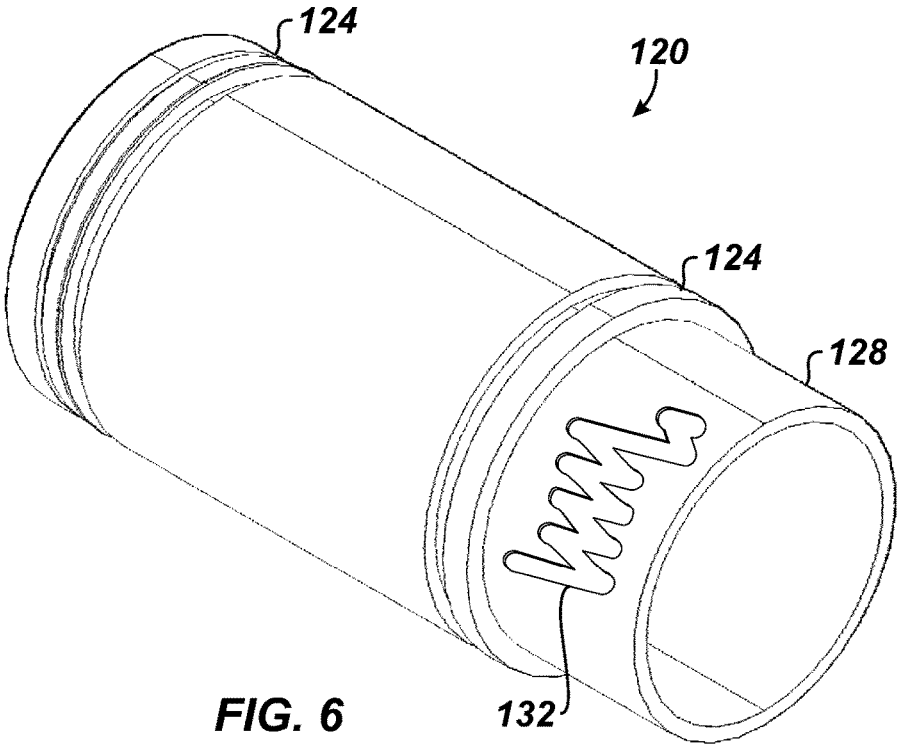
FIG. 6 illustrates a perspective view of the insert with its lower end having a J-slot profile.

The indexing mechanism 130 in one embodiment includes a pin and slot arrangement, such as a pin and J-slot profile between the collet 140 and the insert 120. For example, FIG. 6 illustrates a perspective view of the insert 120 with its lower end's surface 128 having a J-slot profile 132. More than one such profile 132 can be mapped around the surface 128, and the profile 132 can have any number of intermediate slot positions other than those particularly shown.

Figure 7:
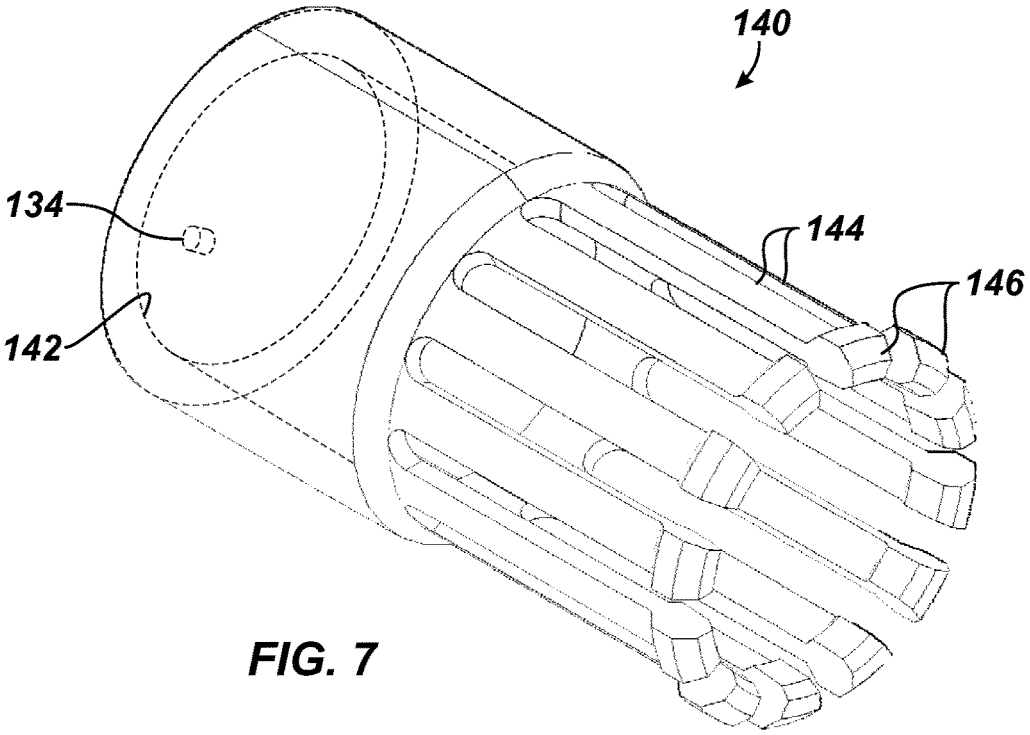
FIG. 7 illustrates a perspective view of the collet with location of the inner pin depicted.

Moreover, FIG. 7 illustrates a perspective view of the collet 140 with a location of the inner pin 134 depicted inside the collet's inner surface 142. When the collet 140 is assembled on the insert 120, the inner pin 134 can ride inside the external J-slot profile 132 mapped around the collet's surface 128, which controls relative movement between the collet 140 and the insert 120 when indexing and counting as discussed below.

The pin and slot arrangement of the indexing mechanism 130 allows relative and coordinated movement between the collet 140 and the insert 120 from a start position, to at least one intermediate position, and to a final position. First axial movement of the sleeve 160 with the engagement of the deployed plug B in a first direction moves the collet 140 downward relative to the insert 120, and second axial movement of the collet 140 by the bias of the fingers 144 in a second, opposite direction moves the sleeve 160 upward relative to the insert 120.

Figure 3B:
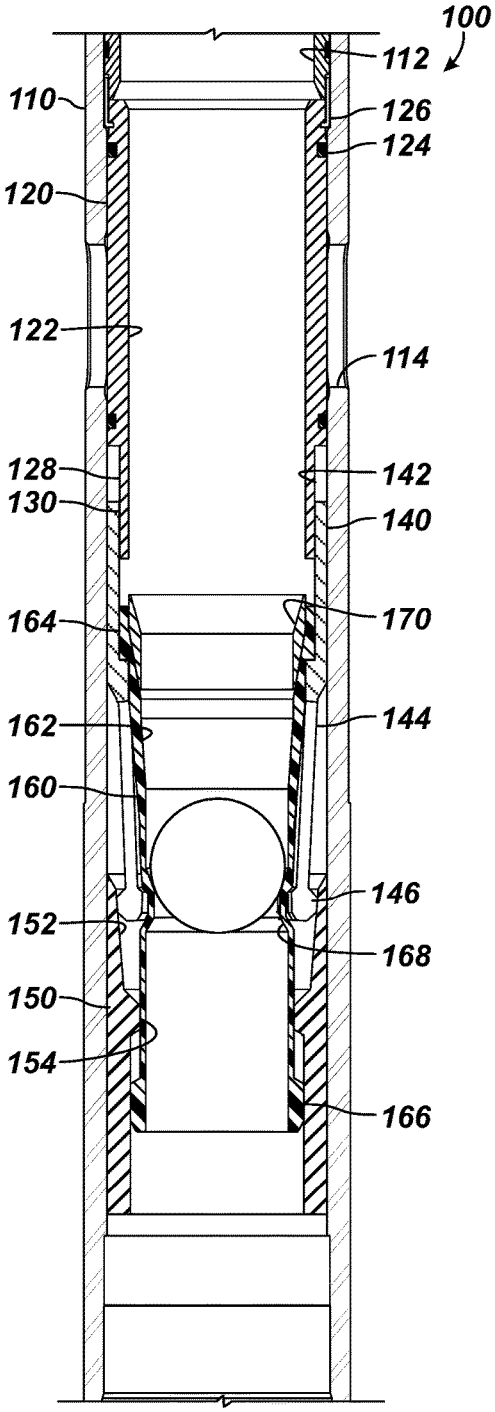
FIG. 3B illustrates the tool of FIG. 3A in a first intermediate condition.

Having an understanding of the components of the disclosed tool 100, discussion now turns to how the tool 100 operates to count the passages of balls B and eventually open to allow fluid flow through the open tool 100. To actuate the tool 100 while initially in its closed position in FIG. 3A, operators drop a ball B downhole and drop/pump the ball B until it reaches the seating sleeve 160 disposed in the housing 110. The ball B engages the seating profile 168 in the seating sleeve 160, which creates a seal therewith. Fluid pressure behind the seated ball B then shifts the seating sleeve 160 axially downward while the ball B remains seated in the profile 168, as shown in FIG. 3B. As this occurs, the shifting sleeve 160 retained by the retainer 170 to the collet 140 also shifts the collet 140 axially downward with it. The heads 146 of the collet's fingers 144 meet the incline 152 of the seat 150 which increases bias against the movement of the collet 140 and the sleeve 160.

Figure 5:
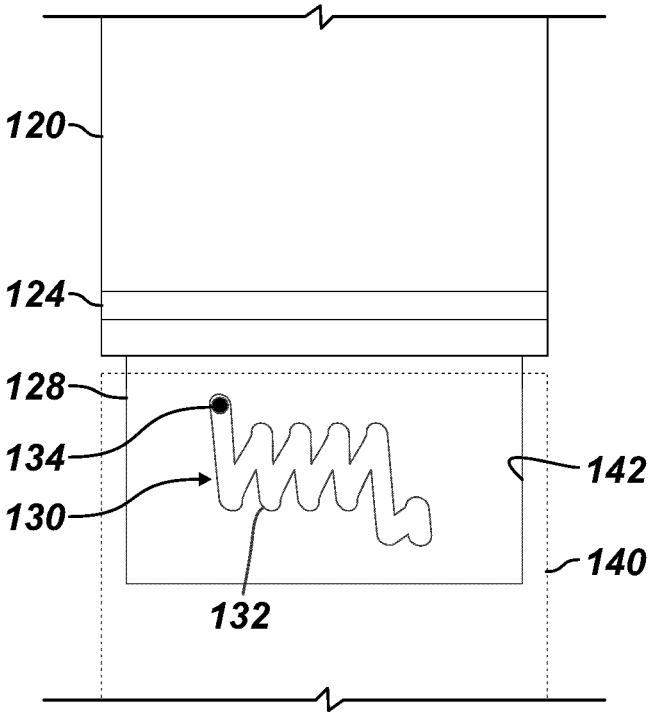
FIG. 5 illustrates an elevational view of a lower end of the insert of the tool engaged with the upper end of the collet.

At the same time, the indexing mechanism 130 (having the pin 134 in the J-slot profile 132 best depicted in FIG. 5) controls the relative movement of the collet 140 to the insert 120. In general, the pin and slot arrangement of the indexing mechanism 130 allows the collet 140 to move axially in a first direction with the engagement of a first of the deployed plugs B from the start position to a first stop position. Yet, the fingers 144 of the collet 140 in the first stop position leave the sleeve 160 unsupported radially because the heads 146 of the collet fingers 144 do not close fully around the seating area 168 of the sleeve 160, as shown in FIG. 3B.

Eventually in the axial movement of the collet 140 downward relative to the insert 120, the pin 134 reaches the first lower transition in the slot 132 so that further downward movement of the collet 140 ceases. The insert 120 does not open at this point because (i) the retention of the retaining feature 126 on the insert 120 is not overcome even though the collet 140 has reached its lower limit and pulls the insert 120 downward with the pin 134 in the first lower transition of the slot profile 132, (ii) the bias of the collet's fingers 144 resist further axial movement downward, and (iii) the inward flexibility of the seating sleeve's profile 168 remains still unsupported by the fingers' heads 146 and gives way to the pressure of the plug B being forced through the seating sleeve 160. As can be seen in FIG. 3B, the diameter of the plug B can expand the unsupported seating profile 168 of the seating sleeve 160, and the released plug B can pass through the tool 100 with the applied pressure behind the plug B.

Figure 3C:
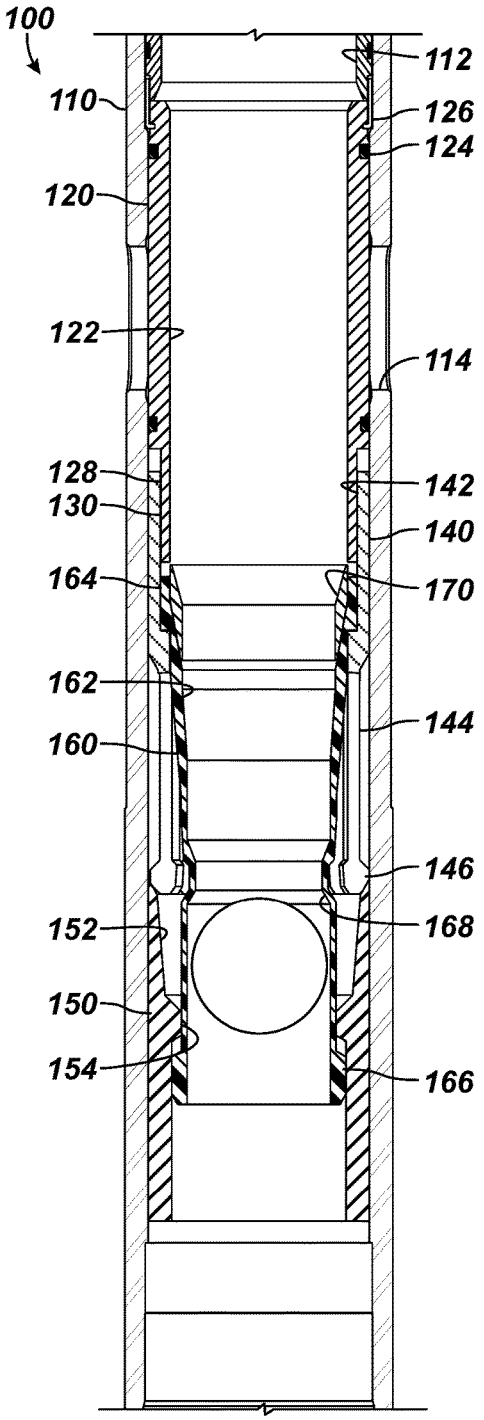
FIG. 3C illustrates the tool of FIG. 3A in a second intermediate condition.

With the plug B free of the seating sleeve 160 as shown in FIG. 3C, the bias of the collet's fingers 144 then shifts the collet 140 axially upward as the fingers' heads 146 ride up the incline 152 of the seat 150. Thus, the pin and slot arrangement of the indexing mechanism 130 allows the collet 140 to move axially in a second, opposite direction from the first stop position to at least one intermediate position with the release of the first deployed plug B and with the bias of the fingers 144 of the collet 140. Accordingly, the collet 140 returns further onto the end of the insert 120. The movement is guided by the indexing mechanism 130, as the pin 134 travels from the first lower transition upward in the profile to the intermediate turnaround where the pin 134 rests.

The tool 100 is now ready to receive passage of the next plug B. When deployed to the tool 100 in its intermediate state in FIG. 3C, the plug B again seats on the seating profile 168 so that the seating sleeve 160 can shift axially downward and move the collet 140 along with it, guided by the indexing mechanism 130. This repeats the positioning of the components to the arrangement depicted in FIG. 3B. The plug B can then be forced through the seating profile 168 as before to pass further downhole, and the collet 140 and sleeve 160 can again return to another intermediate position as depicted in FIG. 3C. This process can be repeated any number of times depending on the transitions and turnarounds configured in the J-slot profile 132.

Eventually (and even after just passage of one plug B if so configured), the indexing mechanism 130 can position in its final intermediate position. For instance as shown in FIG. 5, the pin 134 of the collet 140 may reside in the final turnaround on the J-slot profile. Although the components of the tool 100 are arranged in the configuration of FIG. 3B to accept the next ball B, the collet 140 is configured to move one last time axially downward relative to the insert 120 guided by the pin 134 at the final turnaround of the J-slot profile 132. Moreover, the collet 140 by virtue of its pin 134 in the slot profile 132 is configured to extend axially further from the insert 120 due to the longer extent of the final run on the profile 132.

Figure 3D:
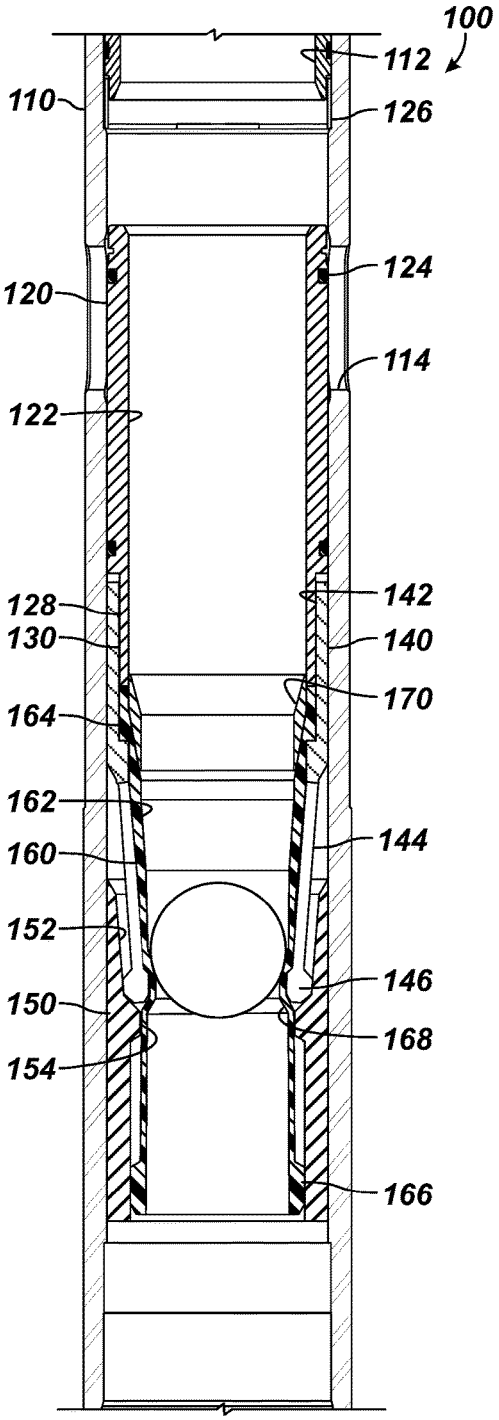
FIG. 3D illustrates the tool of FIG. 3A during a process of opening.

Accordingly, the tool 100 is now ready to receive passage of the final plug B to the tool 100 in its final intermediate state similar to that depicted in FIG. 3C. The plug B again seats on the seating profile 162 so that the seating sleeve 160 can shift axially downward and move the collet 140 along with it. Rather than stopping partially along the way, the collet 140 moves further axially downward as its pin 134 rides further in the last run of the slot profile 132. As a result, the heads 146 of the collet fingers 144 come further inward as shown in FIG. 3D along the incline 152 of the seat 150, and the heads 146 now support the seating profile 168 of the sleeve 160 and further act to seat the ball B. In this way, the fingers 144 and the heads 146 of the collet 140 in the final position provide radial support to the radially-expandable seating sleeve 160 to hold the deployed plug B engaged therein.

Figure 3E:
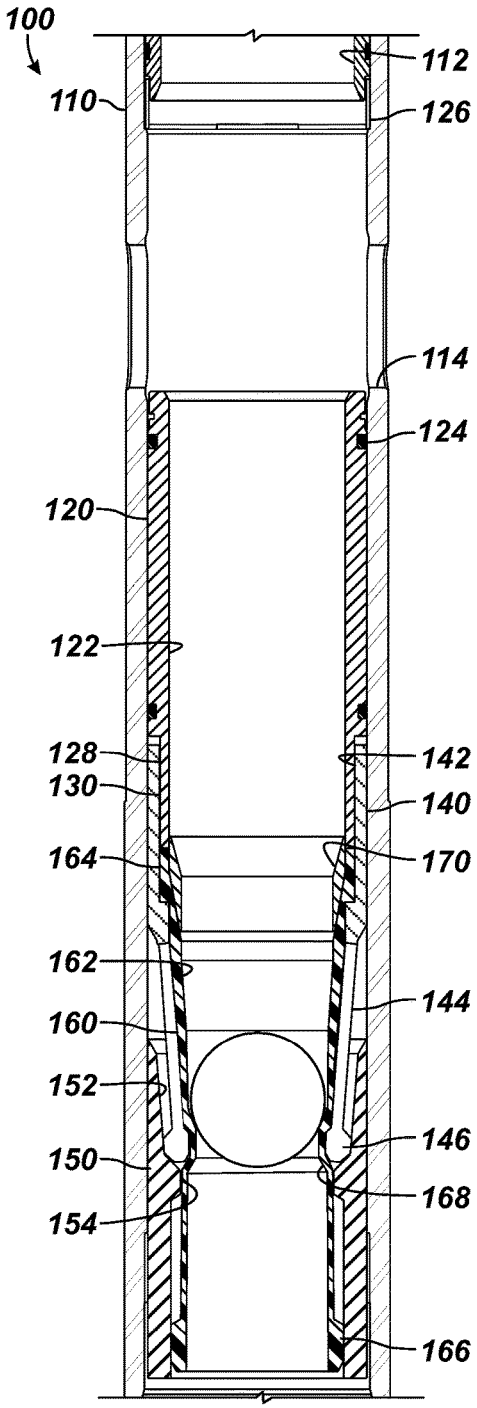
FIG. 3E illustrates the tool of FIG. 3A in an opened condition.

Pressure acting against the plug B can no longer force the plug B through the now-supported seating profile 168, and the acting pressure thereby pushes against the seated plug B and the seat 150. For its part, the seat 150 in one embodiment can be a shiftable component disposed in the housing 110. The applied pressure against the plug B and the seat 150 can then begin shifting the seat 150 in the housing 110 as shown in FIG. 3E so that the movement pulls the collet 140 and the insert 120. Eventually, the shear force of the retainer 126 is breached, and the insert 120 can shift open past the ports 114 in the housing 110.

In this way, fluid pressure applied in the sleeve's bore 112 acts against the seated plug B. At the same time, the applied pressure against the seated plug B forces the insert 120 in the bore 112 against the temporary retainer 126. Eventually, the temporary retainer 126 breaks, freeing the insert 120 to move in the bore 112 from the closed condition to the opened condition. In this and other tools 100 disclosed herein, the shear values required to open the tool 100 can range generally from 1,000 to 4,000 psi, although any acceptable values can be used.

The tool 100 can now be used for fluid communication with the surrounding wellbore for communication treatment fluid, fracture fluid, etc. to the wellbore outside the open tool 100. For example, fracturing can then commence by flowing treatment fluid, such as a fracturing fluid, downhole to the tool 100 so the fluid can pass out the open flow ports 114 to the surrounding formation. The final plug B engaged in the radially-supported seating sleeve 160 prevents the treatment fluid from passing and isolates downhole sections of the assembly.

With the tool 100 is open, for example, operations begin pumping higher pressure treatment (e.g., fracturing fluid) downhole to the open tool 100. In this and other embodiments of tool 100 disclosed herein, the pressures used in the fracturing operation can reach as high as 15,000-psi. It should be noted that the support provided by the seat 150, the seating sleeve 160, and the collet heads 146 does not need to be entirely leak proof because the fracturing treatment may merely need to sufficiently divert flow with the seated ball B and maintain pressures. Yet, the additional engagement of the plug B provided by the seating sleeve 160 is intended to improve the fluid seal even at higher fracturing pressures.

As noted above, the seating sleeve 160 can be composed of a suitable material, including, but not limited to, an elastomer, a hard durometer rubber, a thermoplastic such as TORLON®, a soft metal, an elastically deformable material, a plastically deformable material, PEEK, or a combination of such materials. The particular material used and durability of the material used for the sleeve 160 can be configured for a given implementation and expected pressures involved. Moreover, the selected durability can be coordinated with expected pressures to be used downhole during an operation, such as a fracturing operation, and can be coordinated with the configured breaking point of the retaining feature 126 or other temporary attachments used in the tool 100.

Once the treatment is complete for this tool 100, similar operations can be conducted uphole to treat other sections of the wellbore. After the fracturing job is completed, the well is typically flowed clean, and the plugs B are floated to the surface. Sometimes, the plugs B may not be floated or may not dislodge from the tool 100. Instead, the plugs B can be dissolvable or the like. In any event, the seat 150, seating sleeve 160, and collet 140 (and the plug B if remaining) can be milled out to provide a consistent inner dimension of the tool 100. To facilitate milling, the seat 150 and the collet 140 can be constructed from cast iron, and the plug B can be composed of aluminum or a non-metallic material, such as a composite.

Once milling is complete, the insert 120 can be closed or opened with a shifting tool. For example, the insert 120 can have tool profiles (not shown) so the tool 100 can function like any conventional sliding sleeve that can be shifted opened and closed with a convention tool, such as a "B" tool. Other arrangements are also possible.

Figure 8A:
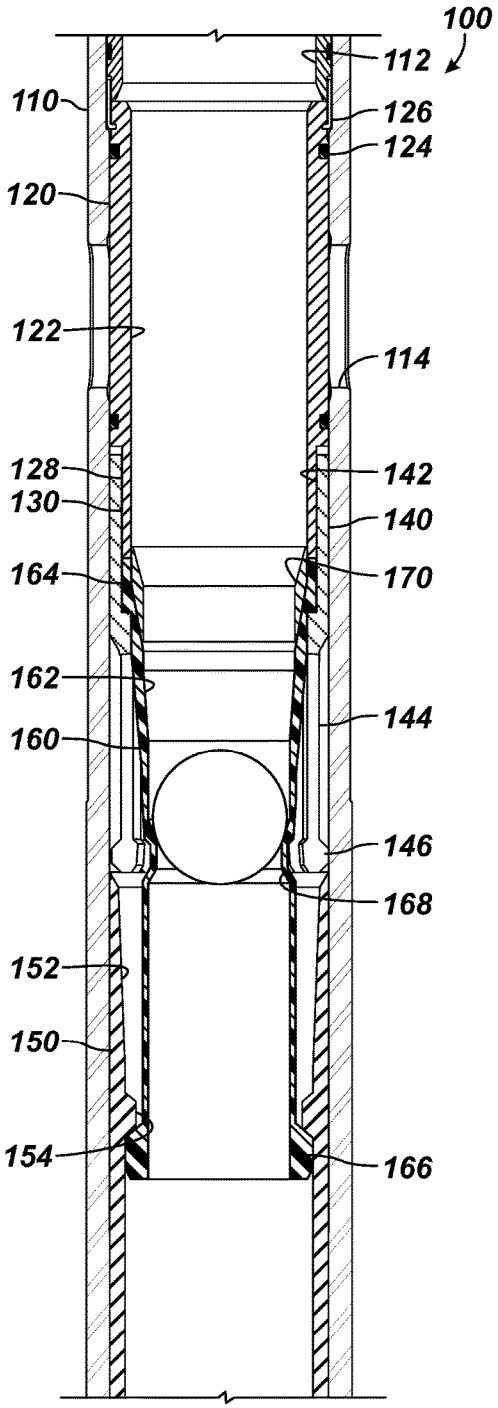
FIGS. 8A-8C illustrate an alternative embodiment of the disclosed tool during opening.
Figure 8B:
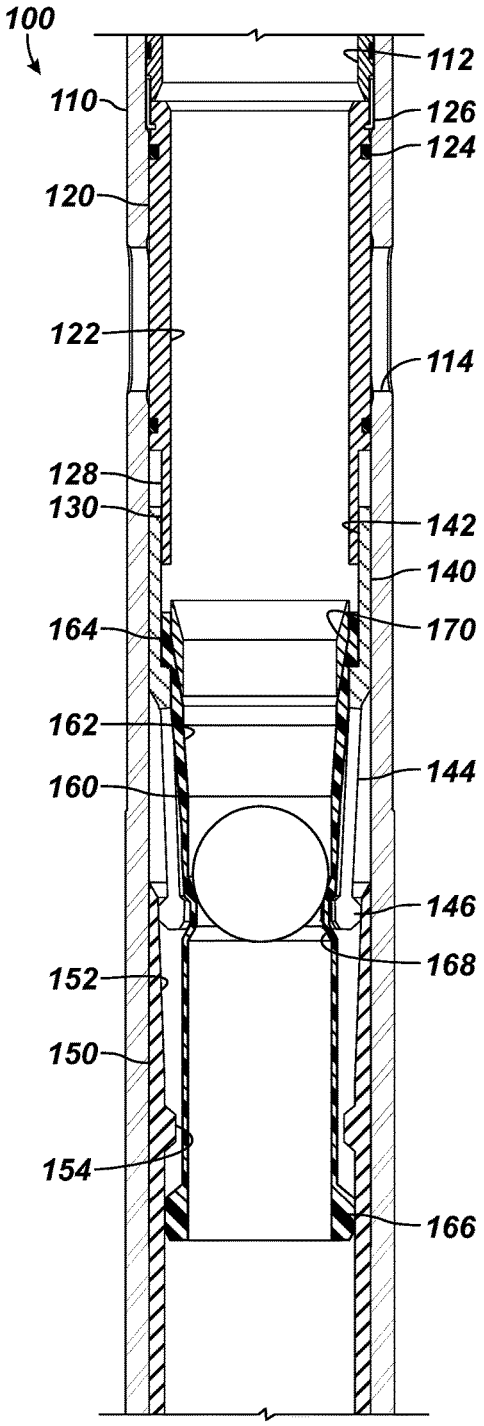
Figure 8C:
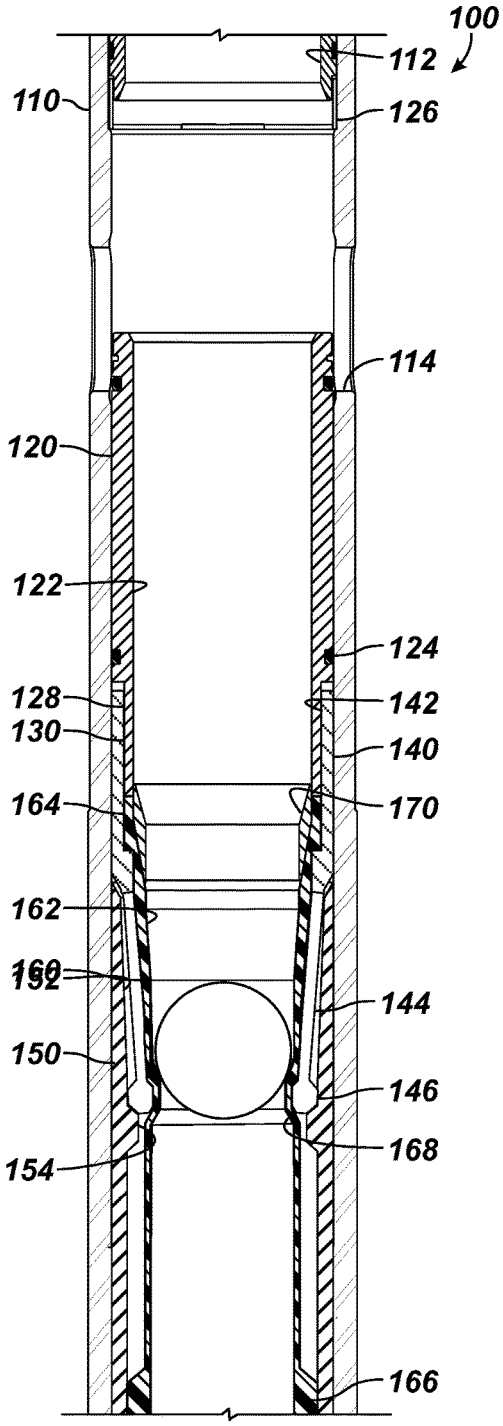

In an alternative arrangement as shown in FIGS. 8A-8C, the seat 150 may not be a shiftable component. Instead, the incline 152 of the seat 150 may extend a greater extent and come together to a uniform profile, as shown in FIG. 8A. In the intermediate position shown in FIG. 8B, the heads 146 of the collet 140 can ride partially along the incline 152 and still not form external support for the sleeve 160 so that the plug B can eventually expand the seating sleeve 160 and pass out of the tool 100. In the final position shown in FIG. 8C, however, the heads 146 can slide further along the seat 150 by virtue of the indexing mechanism 130 and can then maintain a seat with the seating profile 168 against the plug B. Movement of the collet 140 can in turn pull the insert 120 against the retainer 126 and eventually break it free. Yet, shifting of the seat 150 in the bore 112 of the insert 110 does not need to occur.

Although an implementation has been proposed in which the same size plug B is deployed downhole to index through multiple tools 100 and eventually actuate one of the tools 100 open, it will be appreciated that different sized plugs B can be used for various ones of the tools 100 with the seating components properly sized, and it will be appreciated that a combination of different and same sized plugs B can be used.

Although the pin and slots arrangement for the indexing mechanism 130 as disclosed above has the pin 134 situated on the collet 140 and has the J-slot profile 132 defined on the insert 120, an opposite arrangement could be used with a pin situated on the insert 134 and a J-slot profile defined on the collet 140 in an inverted orientation. In other alternatives, the tool 100 can include a secondary indexing mechanism to expand the counts. Also, the indexing mechanism 130 for the tool 100 can be radially actuated.

Although the incline 152 of the seat 150 is depicted in some embodiments as part of the seat 150 and a separate component from the housing 110, this is not strictly necessary. Instead, portion of the housing 110 may have portion of the incline 152 for engaging the heads 146 of the collet fingers 144. In embodiments where the seat member 150 is not separately movable in the housing 110 as in the embodiments of FIGS. 8A-8C, the features of the seat member 150 can instead be integral to the housing 110.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Accordingly, features and materials disclosed with reference to one embodiment herein can be used with features and materials disclosed with reference to any other embodiment.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool being disposed on tubing and being operable with pressure applied against one of a plurality of plugs deployed in the tool, the tool comprising:

an insert disposed in the tool and being movable from a first position toward a second position;

a sleeve disposed in the tool, the sleeve being engageable with the deployed plugs and being movable with the engagement, the sleeve being expansive in an absence of external support and releasing the engaged plug in response to the expansion; and an indexing mechanism disposed in the tool and being operable between the sleeve and the insert, the indexing mechanism moving with the sleeve in response to the engagement with the deployed plugs and counting the engagements, the indexing mechanism in response to a predetermined count of the engagements forming the external support of the one deployed plug and moving the insert from the first position toward the second position with the pressure applied against the one deployed plug engaged in the sleeve and supported by the indexing mechanism.

2. The tool of claim 1, wherein the tool comprises a housing defining a first bore and defining a flow port communicating the first bore outside the housing; wherein the insert is movably disposed in the first bore of the housing from the first, closed position to the second, opened position relative to the flow port and defines a second bore therethrough for passage of the deployed plugs; and wherein the sleeve is movably disposed in the first bore of the housing and defines a third bore therethrough for passage of the deployed plugs.

3. The tool of claim 1, wherein the indexing mechanism operable between the sleeve and the insert is reciprocally movable in first and second opposite directions up to the predetermined count.

4. The tool of claim 3, wherein the indexing mechanism is biased relative to a portion of the tool, the indexing mechanism counting the movement of the sleeve in the first direction by the engagement of one or more initial of the deployed plugs and resetting in the second direction with the bias relative to the portion.

5. The tool of claim 4, wherein the portion of the tool comprises a seat against which the indexing mechanism is biased, the seat being fixed in the tool or being movable in the tool in the first direction.

6. The tool of claim 4, wherein the indexing mechanism at the predetermined count moves with the sleeve in the first direction by the engagement of a last of the deployed plugs, moves the insert toward the second position, and provides the external support for the engagement of the last of the deployed plugs.

7. The tool of claim 1, wherein the indexing mechanism comprises a collet operably coupled between the sleeve and the insert, the collet having fingers biasing against a surface in the tool.

8. The tool of claim 7, wherein the surface of the tool comprises an inclined surface of a seat against which the collet fingers are biased, the seat being fixed in the tool or being movable in the tool in the first direction.

9. The tool of claim 7, wherein the collet is affixed to the sleeve, whereby the sleeve moving in a first direction in the tool with the engagement of the deployed plug moves the collet in the first direction toward the surface, and whereby the collet moving in a second direction opposite to the first direction by the bias of the fingers against the surface moves the sleeve in the second direction in the tool.

10. The tool of claim 9, wherein the indexing mechanism comprises a pin and slot arrangement coupling the collet to the insert, the pin and slot arrangement allowing movement of the collet relative to the insert from a start position, to at least one intermediate position, and to a final position.

11. The tool of claim 10, wherein in response to the engagement of a first of the deployed plugs with the sleeve, the pin and slot arrangement allows the collet to move in the first direction relative to the insert from the start position to a first stop position; and wherein the fingers of the collet in the first stop position leave the sleeve in the absence of the external support.

12. The tool of claim 11, wherein in response to the release of the first deployed plug from the sleeve and in response to the bias of the fingers of the collet, the pin and slot arrangement allows the collet to move in the second direction relative to the insert from the first stop position to the at least one intermediate position.

13. The tool of claim 12, wherein in response to the engagement of a second of the deployed plugs with the sleeve, the pin and slot arrangement allows the collet to move in the first direction relative to the insert from the at least one intermediate position to the final position; and wherein the fingers of the collet in the final position provide external support to the sleeve to hold the second deployed plug engaged therein.

14. The tool of claim 1, wherein the sleeve comprises a restriction therein for engaging with the deployed plugs, the restriction at least partially being longitudinally rigid and radially flexible.

15. The tool of claim 14, wherein the sleeve comprises a tubular structure with a continuous wall thereabout, the restriction being a throat of reduced diameter formed around the continuous wall.

16. An apparatus being operable with a plurality of plugs deployed through tubing downhole in a borehole, the apparatus comprising:

a first tool disposed on the tubing and configured to operate in response to a first count of the deployed plugs; and a second tool disposed on the tubing and configured to operate in response to a second count of the deployed plugs greater than the first count, wherein the first and second tools each comprise:

an insert disposed in the tool and being movable from a closed position toward an opened position relative to a flow port of the tool;

a sleeve disposed in the tool, the sleeve being engageable with the deployed plugs and being movable with the engagement, the sleeve being expansive in an absence of external support and releasing the engaged plug in response to the expansion; and an indexing mechanism disposed in the tool and being operable between the sleeve and the insert, the indexing mechanism moving with the sleeve in response to the engagement with the deployed plugs and counting the engagements, the indexing mechanism in response to the respective count of the engagements forming the external support of the one deployed plug engaged in the sleeve and moving the insert from the closed condition toward the open condition with the pressure applied against the one deployed plug engaged in the sleeve and supported by the indexing mechanism.

17. A method for tubing downhole in a borehole, comprising:

deploying one or more initial plugs downhole to a first tool on the tubing;

indexing the first tool to a first count by reciprocally moving a radially expandable sleeve in first and second opposite directions in the first tool with the one or more first plugs engaged therein and releasing the one or more initial plugs from the radially expandable sleeve;

deploying a subsequent plug downhole to the first tool indexed to the first count;

moving the radially expandable sleeve in the first direction in the first tool with the subsequent plug engaged therein;

holding the subsequent plug in the first tool by wedging collet fingers around the radially expandable sleeve with the movement of the sleeve in the first direction to radially support the radially expandable sleeve; and actuating an insert in the first tool in response to fluid pressure applied against the subsequent plug held in the radially supported sleeve.

18. The method of claim 17, wherein indexing the first tool to the first count comprises guiding a pin in a slot defined between the insert and the radially expandable sleeve.

19. The method of claim 17, wherein reciprocally moving the sleeve comprises biasing the sleeve in the second direction opposite to the movement the sleeve in the first direction by the engagements with the deployed plugs.

20. The method of claim 17, wherein actuating the insert in the first tool comprises shifting the insert relative to a flow port communicating outside the first tool.

21. The method of claim 17, further comprising:

indexing a second tool uphole of the first tool to a second count by reciprocally moving a radially expandable sleeve in first and second opposite directions in the second tool with the one or more first and subsequent plugs engaged therein and releasing the one or more initial and subsequent plugs from the radially expandable sleeve;

deploying a following plug downhole to the second tool indexed to the second count;

moving the radially expandable sleeve in the first direction in the second tool with the following plug engaged therein;

holding the following plug in the second tool by radially supporting the radially expandable sleeve; and actuating an insert in the second tool in response to fluid pressure applied against the following plug held in the radially supported sleeve.

* * * * *